United States Patent [19]

Peevey

[11] 3,941,189

[45] Mar. 2, 1976

[54] SUBSURFACE WELLHEAD SHIELD

[75] Inventor: Robert M. Peevey, Carriere, Miss.

[73] Assignee: Standard Oil Company, Chicago, Ill.

[22] Filed: Nov. 18, 1974

[21] Appl. No.: 525,041

[52] U.S. Cl. ..... 166/.5; 166/75 R

[51] Int. Cl.[2] ..... E21B 7/12

[58] Field of Search .. 166/.5, 92, 93, 94, 55,315,75; 175/219, 5–10; 61/46, 46.5, 69, 72.3

[56] References Cited

UNITED STATES PATENTS

| | | | |
|---|---|---|---|
| 1,830,061 | 11/1931 | Howe | 175/219 X |
| 3,004,612 | 10/1961 | Kofahl | 166/.5 X |
| 3,078,933 | 2/1963 | Orner | 175/219 |
| 3,202,218 | 8/1965 | Watts et al. | 166/.5 |
| 3,379,245 | 4/1968 | Manning | 61/46 X |
| 3,395,755 | 8/1968 | Manning | 175/8 X |
| 3,461,957 | 8/1969 | West | 166/.5 |
| 3,626,701 | 12/1971 | Laffont | 175/7 X |
| 3,670,814 | 6/1972 | Childers | 166/.5 |

*Primary Examiner*—Frank L. Abbott
*Assistant Examiner*—Richard E. Favreau
*Attorney, Agent, or Firm*—John D. Gassett; Paul F. Hawley

[57] ABSTRACT

This invention concerns means for protecting a marine wellhead (including the Christmas tree) on an offshore hydrocarbon-producing platform from damage due to fire. Special means are provided to protect a wellhead placed a small depth, e.g., 25 to 50 feet, below the water surface under the deck of the offshore platform. These special means include a horizontal support frame supported by the platform. The wellhead is supported at about the same level as the support frame. A heavy shield comprising a heavy framework somewhat bell- shaped with an open bottom is lowered over the wellhead and comes to rest on the fixed frame or shelf. This shield is removable, but is ordinarily kept in position. In event of a fire on the production platform above the submerged wellhead, debris that may fall from the platform is diverted by the shield. Ocean water continually surrounds the marine wellhead, so that, in case of fire, it cannot be damaged by heat.

4 Claims, 3 Drawing Figures

SUBSURFACE WELLHEAD SHIELD

RELATED APPLICATION

U.S. Pat. application Ser. No. 525,046, filed Nov. 18, 1974, entitled "Underwater Wellhead Completion With Portable Cellar," by James T. Rodgers, relates to a similar problem as does this specification.

BACKGROUND OF THE INVENTION

1. Field of the Invention

This invention relates to an offshore platform for producing oil from a well drilled to an underground hydrocarbon reservoir beneath the body of the water in which the platform is located. It relates especially to a structure for protecting the wellhead from damage due to fire. The term "wellhead", as used herein, includes the "Christmas tree", which also includes the master valves, tees, swab valves, and wing valves, which sit on the casing spool and hanging equipment. It concerns particularly the placing of the wellhead beneath the surface of the body of water and includes a shield to protect the wellhead from any falling debris.

2. Setting of the Invention

In recent years, there has been considerable attention directed to the drilling and production of oil and gas wells located in water. Walls may be drilled in the ocean floor from either fixed platforms in relatively shallow water, or from floating structures or vessels in deeper water. At present, the most widely used means is the fixed platform which includes the driving or otherwise anchoring of long piles in the ocean floor. Such piles extend above the surface of the water with a working deck or platform attached to the top of the piles. In using such fixed platforms, the drilling rig is set on the platform above the surface of the water and the wells are normally drilled using generally dry land techniques. After the well is drilled, producing equipment, separators, wellheads, and the like, are located on the platform itself above the surface of the water. There are usually many wells, e.g., eight to 16, drilled from one offshore platform, and this involves a corresponding number of wellheads. One problem with this particular type setup is the danger of damage to the wellheads by fire. There has been at least one instance that a fire occurred and the wellheads worked perfectly in shutting off the flow of fluid, but excessive heat from the burning of petroleum being processed, or fuel stored on the deck of the platform itself, damaged the wellheads so they leaked. That fire would have burned itself out as soon as stored fuel or petroleum on the platform was exhausted except for the fact that the fire and heat damaged the wellheads causing them to leak and add more fuel to the fire. This, of course, resulted in the wells producing in an uncontrolled state and the fire continued for weeks until such time as the wells were killed by drilling directional wells for bottom-hole control. This is a tremendous loss of matural resources, and also a tremendous expense. Presently, there is a reluctance in the offshore industry to include normal production equipment on the same platform structure with the producing wellheads. This reluctance is based on safety considerations, primarily to prevent exposing the producing wellheads to fire or high temperature resulting from fire. As an alternative, therefore, the industry is often setting two platforms side-by-side with the wells on one platform and the production equipment on the other. Needless to say, this is a significant added investment over a single platform installation.

3. Prior Art

No prior art is known which describes the invention claimed herein. There is considerable art in the field of offshore producing platforms. Some related art, dealing with installing controls and operating underwater wellheads, include U.S. Pat. Nos. 2,970,646; and 3,395,755; and Canadian patent No. 890,146. All of these patents are concerned with an undersea well where the wellhead controls are on the sea floor.

BRIEF SUMMARY OF THE INVENTION

This invention concerns an offshore platform for producing hydrocarbons from an underground formation under the bottom of a body of water. The platform includes piles which were driven to the bottom of the body of water and extend to above the surface where they support a working deck. A wellhead base is supported by the platform beneath the deck below the surface of the water. The conductor pipe extends from the well beneath the body of water up to the wellhead base. The normal wellhead is mounted on top of the conductor pipe, just above the wellhead base. A portable shield or frame is provided and can be lowered from the work deck to rest on the wellhead base. The shield is open on the sides and permits water to flow through the framework so as to provide small resistance to current. The cellar shield is closed, or, at least, has a closely arranged framework at the top to prevent falling debris from striking the wellhead. As the wellhead is always submerged in the body of water, even a very severe fire on the working deck of the platform can cause no heat damage to the wellhead. Additionally because of the cellar shield, which is provided over the wellhead, even falling debris from the wellhead work deck will be diverted from the wellhead and prevent damage thereto.

BRIEF DESCRIPTION OF THE DRAWINGS

A better understanding of the invention and various modifications and objects thereof can be made with the following description taken in conjunction with the drawings, in which.

DETAILED DESCRIPTION OF THE INVENTION

Figure 1:
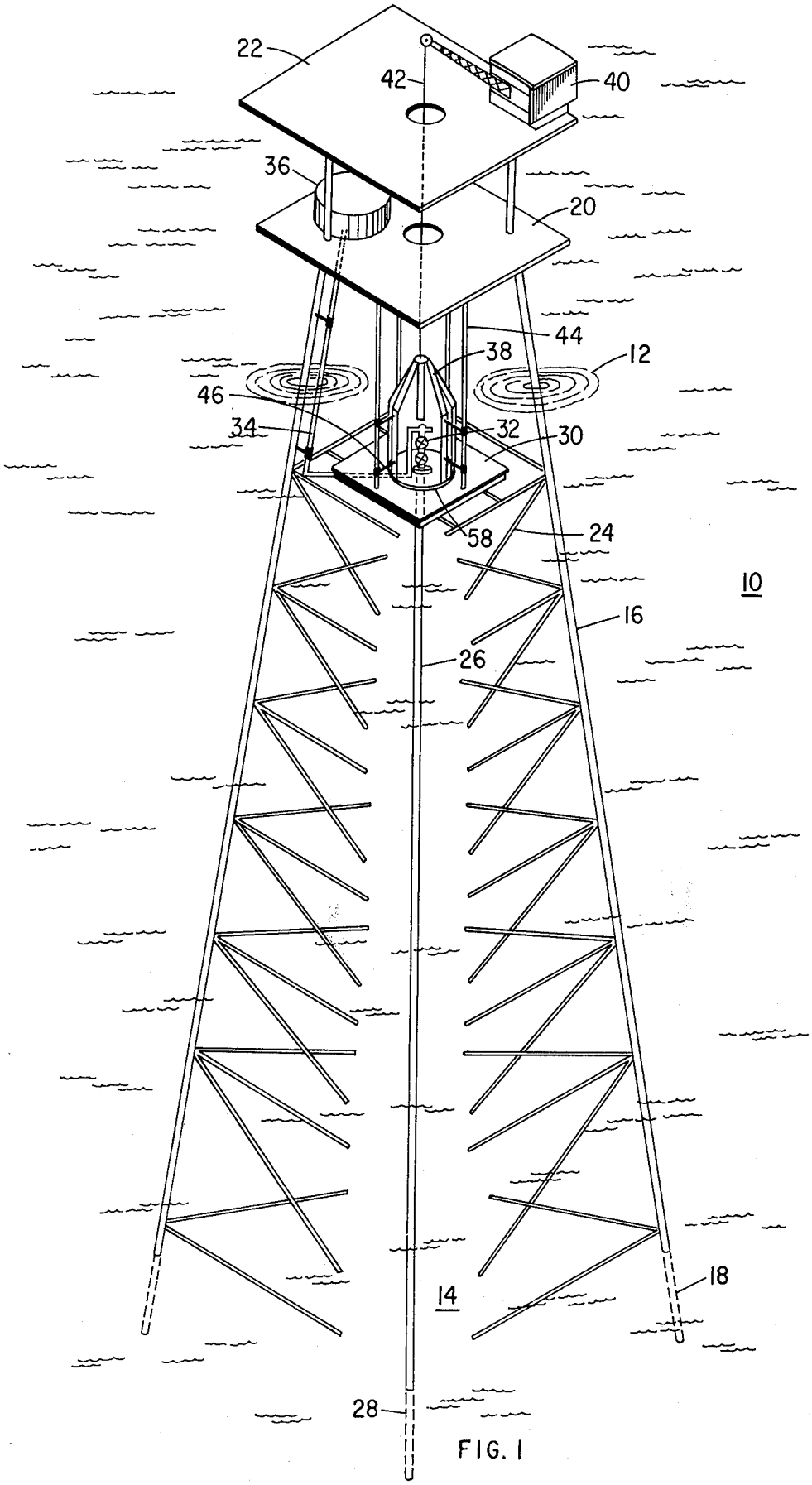
FIG. 1 is an isometric view of an offshore production platform featuring an embodiment of this invention.
Figure 2:
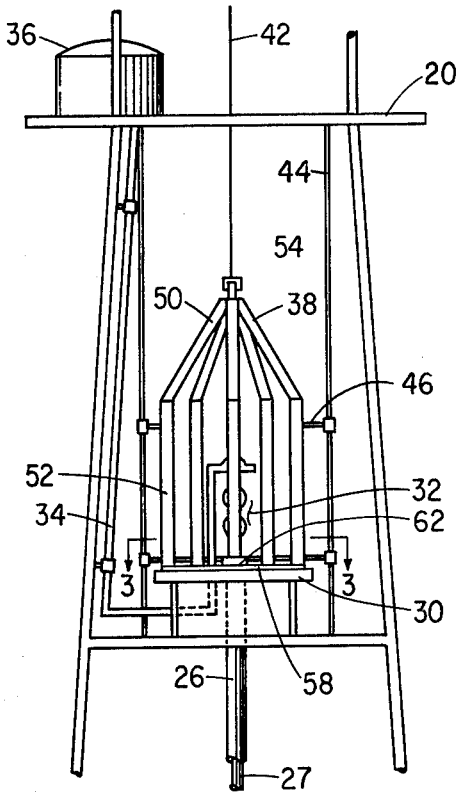
FIG. 2 illustrates an enlarged view of the cellar wellhead shield in place.
Figure 3:
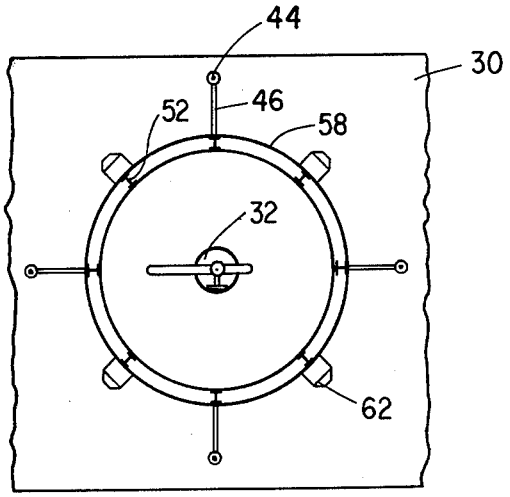
FIG. 3 illustrates a sectional view taken along the line 3—3 of FIG. 2.

Attention is first directed to FIG. 1 which shows a platform in a body of water 10 which has a surface 12 and a bottom 14. Legs or piling 16 are driven into the ocean bottom 14, as indicated by dotted lines 18. Piling 16 continues above the surface 12 of the water and supports a first or lower deck 20 and an upper deck 22. Cross bracing 24 connects legs 16 to give them added rigidity. A drive pipe 26 extends from a well indicated by dotted lines 28, which has been drilled in the bottom of the body of water to wellhead base 30 just beneath the surface of the body of water. Ordinarily, the base 30 is about 25 to 30 feet below the surface of the body of water. A wellhead 32 is connected to the top of drive pipe 26 and other strings of casing or tubing within drive pipe 26 and is supported by baseplate 30. The depth of wellhead 32 and baseplate 30 is sufficient so that wellhead 32 is always below the surface of the body of water. This would normally be so that the wellhead 32 is below the trough of the maximum design wave. The tubing or the producing string of pipe through which petroleum is produced is contained within a drive pipe 26 and casing 27 (as shown in FIG. 2) in a known manner, and extends downwardly to the underground producing formation or reservoir. A well producing flowline 34 extends from wellhead 32 to producing facilities 36 on deck 20.

Attention will now be directed toward means of protecting wellhead 32, especially from damage due to falling debris. A heavy shield or frame 38, which may be generally bell-shaped with an open end, is provided to fit over wellhead 32. The top of shield 38 is only slightly higher than the top of wellhead 32; thus, the shield too will be submerged in the water.

Shield 38 is lowered from crane means 40 by cable or line 42. Guidelines 44 are provided and extend from baseplate 30 to lower deck 20. Shield 38 has guide arms 46, which have outer ends which slideably encompass guidelines 44. The use of guidelines 44 and arms 26 are well known for guiding devices into place under water. Therefore, no detailed explanation will be given. The guidelines 44 also serve to hold the shield 38 in a proper position while lowering and removing it.

There is shown only one wellhead 32 in associated well 28. However, there will ordinarily be many such wells and wellheads for each offshore platform.

Attention is next directed to FIG. 2 which shows an enlarged view of the portable cellar or shield 38 in position. A part of the structure of the platform has been omitted to more clearly show the details of the invention. The frame, as shown, includes vertical I-Beam members 52 and slanting members 50 at the top of the vertical members which come together at an apex 54, to which line 42 is attached. The vertical members 52 are connected at their bottom end to a ring 58. If desired, shield 38 can include an environmental shield. The environmental shield can be wire mesh or solid steel sheeting mounted over members 50 and 52, for example to protect the wellhead area from the normal underwater environment. If a solid sheeting is used, it would reduce the amount of marine growth on the submerged wellhead, thus making it easier to service, when necessary.

After the well is put on production, that is, wellhead 32 completely installed and in an operating condition, the cellar wellhead shield 38 is lowered into position.

As shown, it is normally desired to lower it on wirelines 44 stretched between wellhead base 30 and lower deck 20. However, other means, such as use of wire or pipe could be utilized. A remotely operable latching mechanism, indicated generally at 62, can be used to assist in holding the wellhead shield in position, although this may not be necessary if lines 44 are left in position and under tension. The cellar wellhead shield remains in position during normal operations. If desired, the cellar wellhead shield can be removed and stored on the platform during a hurricane or other abnormal wave conditions to lessen the wave force on the platform. In this case, the well would be secured to prevent inadvertent flow before the shield is removed. However, chances of wanting to remove the shield to lessen wave force on the platform are low. If the shield were removed for such purposes, one would probably close in subsurface safety valves and/or set plugs in the producing tubing string.

While the above invention has been described in considerable detail, it is possible to make modifications thereof without departing from the spirit or scope of the invention.

I claim:

1. A marine installation for producing fluids from an underground reservoir beneath the bottom of a body of water which comprises;

a deck;

non-buoyant support means supporting said deck above said body of water;

a wellhead base supported by said support means beneath said deck below the surface of said body of water and above said bottom;

a wellhead supported on said wellhead base;

a producing line from said wellhead to said deck;

a portable shield for placing over said wellhead, said shield including a framework extending horizontally and vertically over the wellhead to protect it from falling debris and to permit water to flow by said wellhead; and a flowline from said wellhead to said underground reservoir.

2. An installation as defined in claim 1, including an environmental shield placed on said frame.

3. An installation as defined in claim 2, in which said environmental shield is wire mesh.

4. An installation as defined in claim 2, in which said environmental shield is solid sheeting.

* * * * *